US006004094A

United States Patent [19]

Precetti

[11] Patent Number: 6,004,094

[45] Date of Patent: Dec. 21, 1999

[54] RADIALLY SEALED CENTRIFUGAL PUMP

[75] Inventor: Massimo Precetti, Fosdinovo, Italy

[73] Assignee: Termomeccanica S.p.A., Italy

[21] Appl. No.: 09/189,292

[22] Filed: Nov. 10, 1998

[30] Foreign Application Priority Data

May 20, 1998 [IT] Italy ..... MI98A1112

[51] Int. Cl.[6] ..... F01D 11/00; F01D 25/16; F03B 11/06; F04D 29/08

[52] U.S. Cl. ..... 415/112; 415/111; 415/118; 415/172.1; 415/176; 415/102; 415/98

[58] Field of Search ..... 415/111, 112, 415/118, 172.1, 176, 102, 98

[56] References Cited

U.S. PATENT DOCUMENTS

| | | | |
|---|---|---|---|
| 794,185 | 11/1905 | Meden | 415/172.1 |
| 1,545,608 | 7/1925 | Schmidt et al. . | |
| 4,208,166 | 6/1980 | Schroeder et al. | 415/170 A |
| 4,242,039 | 12/1980 | Villard et al. | 415/112 |
| 4,501,530 | 2/1985 | Rockwood et al. | 415/170 |
| 4,913,619 | 4/1990 | Haentjens et al. | 415/172.1 |
| 5,163,812 | 11/1992 | Klaus | 415/171.1 |
| 5,779,434 | 7/1998 | De Long | 415/104 |

FOREIGN PATENT DOCUMENTS

| | | |
|---|---|---|
| 355951 | 11/1905 | France . |
| 142214 | 10/1900 | Germany . |
| 639105 | 11/1934 | Germany . |
| 19606856 | 8/1996 | Germany . |
| 186243 | 10/1922 | United Kingdom . |
| 292609 | 8/1927 | United Kingdom . |

OTHER PUBLICATIONS

European Search Report, The Hague, Jun. 14, 1999, Examiner Zidi, K.

*Primary Examiner*—Edward K. Look
*Assistant Examiner*—Rhonda Barton
*Attorney, Agent, or Firm*—Hedman, Gibson & Costigan, P.C.

[57] ABSTRACT

A radially sealed centrifugal pump comprises a casing (2) to which a shaft (4) is rotatably connected, and an impeller (5), connected to said shaft (4), free to rotate within said casing (2), and said pump has, between said casing (2) and said impeller (5) which are in relative motion, opposed surfaces (21, 22) which are substantially perpendicular to the axis of said impeller (5) and which form the seal.

5 Claims, 3 Drawing Sheets

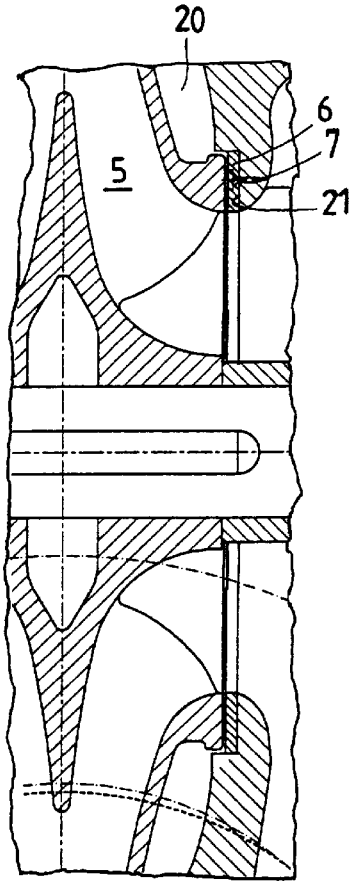
Fig. 2
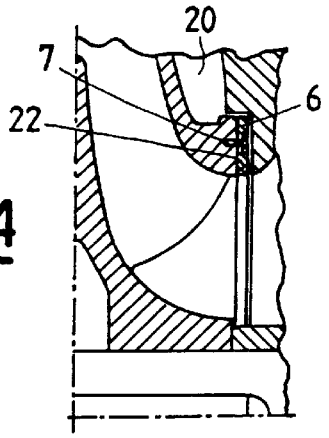
Fig. 4
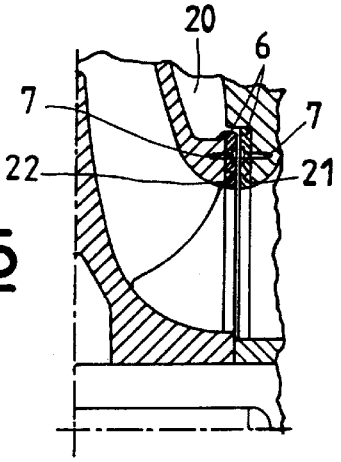
Fig. 5
Fig. 3
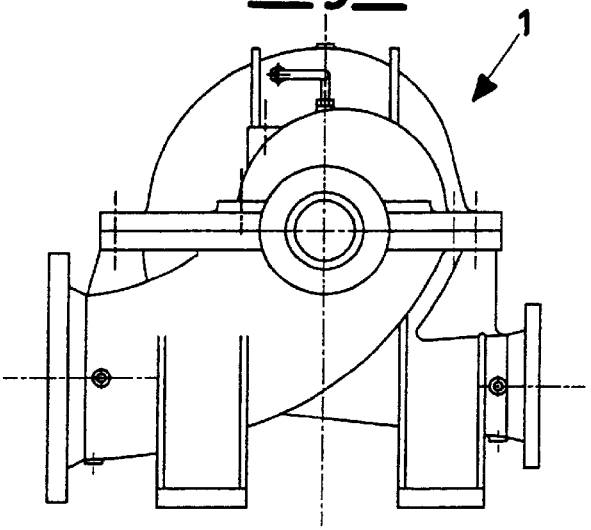

RADIALLY SEALED CENTRIFUGAL PUMP

The present invention refers to a radially sealed centrifugal pump.

In the systems wherein incompressible fluids flow, as for instance water, there are always machines which are provided to move, to lift and in general to supply energy to the circuit water. The pumps are the machines which perform this function, the pumps, according to the working characteristics, are classified as reciprocating, axial, centrifugal pumps, etc.

The centrifugal pumps belong to the family of the turbomachines; in these pumps, the energy exchange between the machine and the fluid is realised through hydrodynamic forces which are exerted by the blades of the machine against the fluid, since said blades are in relative motion as to said fluid.

As known, centrifugal pumps have long been present on the market, said pumps, according to their basic structure, comprise an outer casing, within which an impeller, driven by a shaft connected to a motor, can rotate. Said pumps have, between the casing and the impeller, suitable sealing rings, which perform their function along the generating lines or portions thereof of the opposed surfaces and, which are generally substantially cylindrical and coaxial to said impeller. Further, externally to the casing and/or to the fluid chamber, the pump has plain or rolling bearings in order to realise the rotatable connection of the shaft, whereon the impeller is splined, to said casing. Said pumps have auxiliary circuits and tanks, which are associated to the bearings, in order to contain and to distribute the lubricating grease or oil of the bearings.

As known, said pumps cause a serious decrease in the machine efficiency due to the significant leaks through the seals, in particular between the high and the low pressure chambers.

Further, the machine operation presents often high environmental risks since it is noisy and polluting, because of the presence of the auxiliary circuits for the bearing lubrication and of the production of exhausted lubricating greases and oils. In fact, due to the leaks of lubricant from the seals of the auxiliary circuits, the environment is contaminated by a highly polluting agent; further, the lubricant discharged from a machine, for instance when said lubricant is changed, has to be stored and disposed of in the proper manner. Finally, the structure of said pumps is extremely bulky and complex since it requires, besides the already mentioned auxiliary lubricating circuits, the use of bearings to axially lock the shaft.

A purpose of the present invention is to eliminate the disadvantages of the known art, through the realisation of a centrifugal pump which achieves high levels of efficiency.

Another purpose of the invention is to realise a centrifugal pump which has extremely reduced axial dimensions and, as a consequence, extremely reduced weight.

A further purpose of the invention is to realise a pump without auxiliary lubricating apparatuses and without oil or grease tanks.

Last but not least a further purpose of the invention is to realise an inexpensive and reliable pump.

These purposes are achieved, according to the present invention, by realising a radially sealed centrifugal pump according to claim 1, which is herein taken as reference.

Advantageously, the pump has sealing rings which have smaller dimensions in comparison with the known art and which are reusable if said rings are made, for instance, of chromium plated cast iron.

Further, the pump has pairs of same size rings, associated with the casing and/or with the impeller, said rings are suitable to stand an axial force, they do not pose any ovalization problem and they strongly reduce the thermal expansion and the shaft deflection problems, especially when the shaft has a certain significant length between the supports.

The pump manufacturing, according to the invention, is simplified since the surfaces to be machined, between which the sealing is realised, are flat; the assembly is simplified because the centering is extremely easy and the use and the maintenance are very simple and inexpensive since there is no possibility of seizures and because of the increased easiness to coat and treat flat surfaces.

Finally, the pump has a very low environmental impact since it does not discharge the very polluting exhausted greases or oils which have to be disposed of in a proper manner.

Naturally, all of this results in strongly reduced costs of purchasing, maintenance and operations, besides increased reliability, simplicity and speed during operation and maintenance.

The features and the advantages of the radially sealed centrifugal pump according to the invention will be better understood from the following description of a non limiting example, with reference to the attached schematic drawings, in which:

FIG. 2 is a sectional view of a detail of the pump according to the invention;

FIG. 3 is a side elevation view of the pump according to the invention;

FIG. 4 is a sectional view of a detail of the pump according to the invention and according to a second embodiment;

FIG. 5 is a sectional view of a detail of the pump according to the invention and according to a third embodiment;

Figure 1:
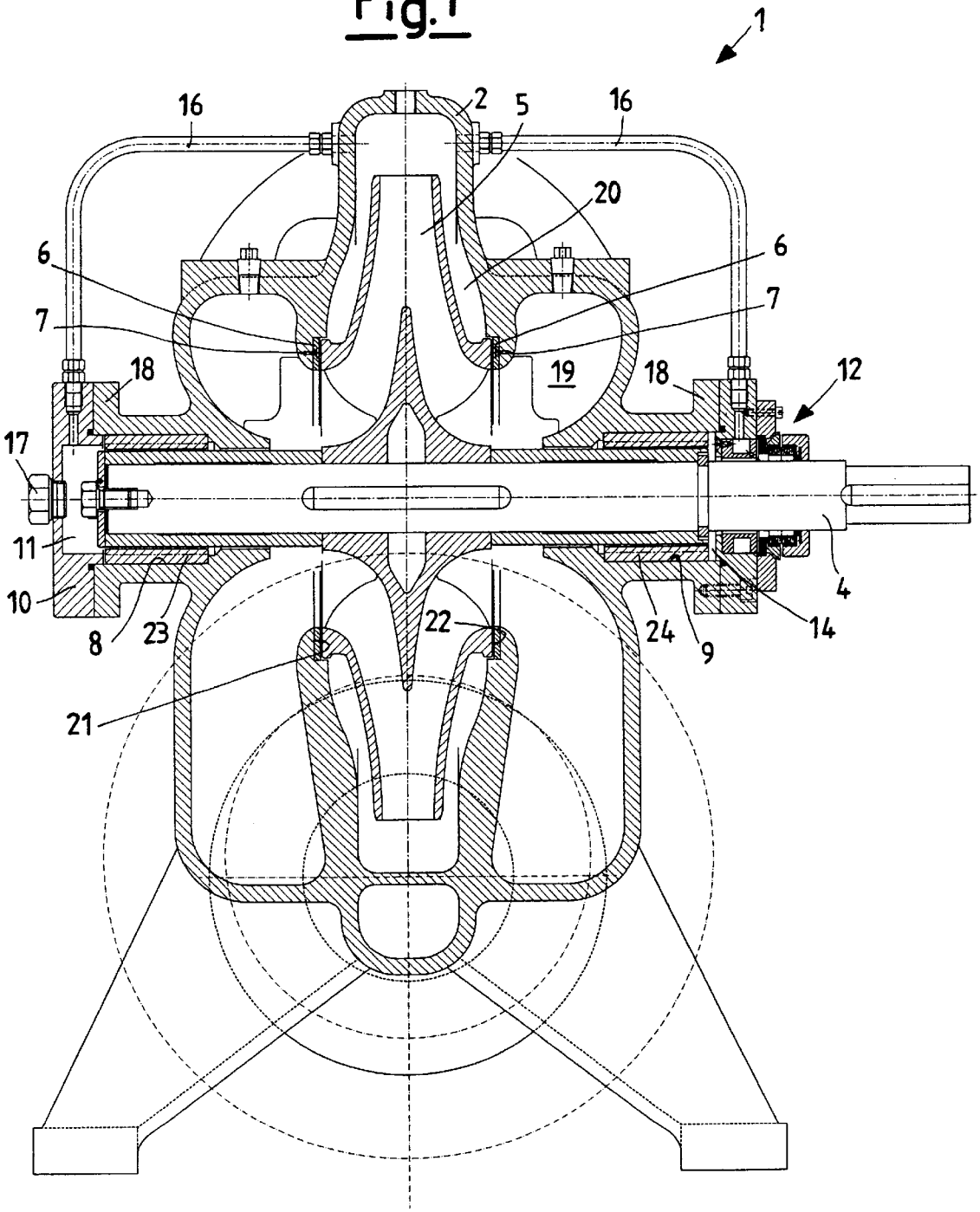
FIG. 1 is a sectional view of the pump according to the invention.

Referring to the above figures, a centrifugal pump, indicated by numeral 1, is shown, wherein a shaft 4, on which an impeller 5 is splined, is rotatably connected within a casing 2.

The casing 2 and the impeller 5 have opposed surfaces 21, 22 perpendicular to the impeller axis, and seal and protection means 6 are placed between said surfaces in order to avoid water leakage from the high pressure chamber 20 to the low pressure chamber 19 and in order to protect the surfaces of the pump main components. Said means 6 comprises a sealing ring which is detachably connected to the casing 2 through locking means 7, as for instance rivets, other mechanical devices and/or bonding agents, or, as in the example, screws. The impeller 5, during operation, transmits centrifugal forces to the water, said forces enhance the sealing efficiency since they move the water away from the axis of the impeller 5.

Further, the ring 6 allows the automatic centering of the impeller 5 within the casing 2 without the need of providing proper axial locking elements. In fact, the ring 6 can transmit axial forces to the casing 2 and the impeller 5, said forces maintain, in a natural and autonomous way, the impeller 5 in its correct position inside the casing 2.

In a different embodiment, the pump, according to the invention, has the sealing ring 6 detachably connected to the impeller 5 (FIG. 4) by means of screws 7; a further embodiment of the pump according to the invention has a couple of sealing rings 6 so that a first ring is connected to the impeller 5 and a second ring is connected to the casing 2 (FIG. 5).

The rings 6 are made of wearing materials with a low friction coefficient in order to have a wearing element which will be changed when the material deterioration is such that it does not guarantee the pump proper operation any more. Said rings are preferably made of synthetic fibers, ceramic materials, sintered powders, ferrous materials coated with suitable materials, for instance chromium plated cast iron rings.

The shaft 4 is rotatably connected to the casing 2 by means of two plain bearings 23, 24 which are positioned in a first and a second cylindrical housing 8, 9 of the casing 2. At the ends of the housings 8, 9 the casing has a ledge 18 to allow the detachable connection of a cover 10 or of sealing means 12. The cover 10 closes said housing 8 and forms a first chamber 11 suitable to contain water. Further, the cover 10 can have an opening to connect said chamber 11 with the outside environment, said opening being closed by means of a threaded cap 17.

A hydraulic connection device 16 connects chamber 11 with a high pressure chamber 20, so as to allow the passage of the water from chamber 20 to chamber 11, this will allow the lubrication of the plain bearing 23, since said chamber 11 is in communication with said bearing.

The housing 9, wherein the second plain bearing 24 is positioned, has its front portion closed by the sealing means 12, which allows the shaft 4 to project from the pump casing 2 and to be connected to a drive machine not shown in the figures. The sealing means 12 define, at the end of the housing 9 of the bearing 24, a chamber 14 which faces the bearing 24, said chamber is connected to the high pressure chamber 20 through the hydraulic connection device 16 and through the sealing means 12. Therefore, the water coming from the high pressure chamber 20 lubricates both the bearing 23 positioned in the housing 8 and the bearing 24 positioned in the housing 9.

Figure 6:
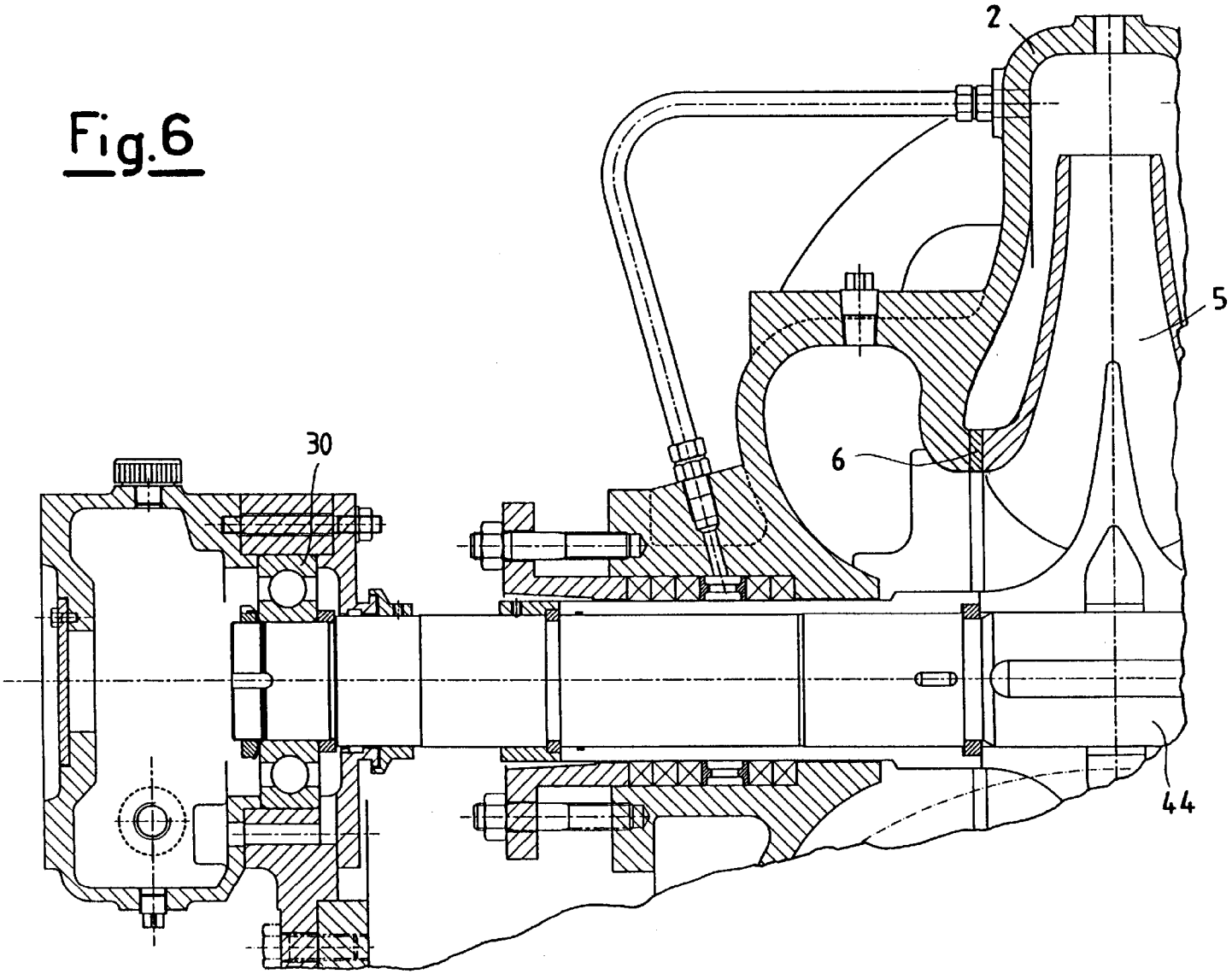
FIG. 6 is a sectional view of a detail of the pump according to the invention and according to a fourth embodiment.

A further embodiment of the pump according to the invention has sealing rings 6 positioned between the casing 2 and the impeller 5, said rings exert, according to the invention, their sealing action along radial surfaces, and ball bearings 30 which support the shaft 44 (FIG. 6).

Another embodiment of the pump according to the invention has sealing rings which exert their sealing action along radial surfaces, and roller bearings which support the shaft and rotatably connect said shaft to the casing.

In this pump embodiment, there is no need for axial locking devices since the sealing ring performs this function (not shown).

The pump operation, according to the invention, is as follows.

The pump inlet water is sent into a low pressure chamber 19 by the impeller 5 which gives up energy to the water, puts said water under high pressure and discharges it into a high pressure chamber 20.

The seal between the chambers 19, 20 is guaranteed by the sealing rings 6, which, since they are detachably connected to the casing 2, move in relation to the impeller 5. Said rings obstruct very efficiently the passage of the water from the high pressure chamber to the low pressure chamber, since the centrifugal forces, transmitted to the water by the impeller, help the execution of said obstructing action.

In a simplified embodiment (not shown), the room taken by the ring or the rings is taken by corresponding portions of the casing 2 and of the impeller 5 and the seal is realised along the opposed surfaces 21, 22. In this case, in order to have a better guarantee of the sealing performance, the surfaces can be treated so as to have a better sliding and wear resistance.

Further, the pump shaft, according to the invention, is rotatably connected to the casing 2 by means of a couple of plain bearings 23, 24. Said bearings are lubricated using the same water treated by the pump and coming from the high pressure chamber 20 through the connection devices 16.

The pump, according to the invention, does not need axial bearings or other components suitable to exert axial forces; in fact, the sealing rings 6 themselves allow the force exchange along the axis, between the impeller 5 and the casing 2.

In practice, it has been observed that the pump, according to the invention, is particularly advantageous because of the high attainable efficiency. Further, the pump is particularly advantageous from an environmental point of view since it reduces the noise and the polluting agents as exhausted greases and oils. Finally, the low manufacturing, maintenance and operation costs of said pump make the whole system inexpensive.

The pump, as herein disclosed, can be subjected to several modifications and changes without leaving the scope of the invention; further, all the details can be replaced by technically equivalent elements.

In practice, the materials and the dimensions can be changed at will according to the needs.

I claim:

1. A radially sealed centrifugal pump for pumping a liquid comprising a casing (2) to which a shaft (4) is rotatable connected, and an impeller (5), connected to said shaft (4), and free to rotate within said casing (2) characterised in that said casing (2) and said impeller (5), which are in relative motion, have opposed surfaces (21, 22) which are substantially perpendicular to the axis of said impeller (5) and which form a seal said pump comprising at least plain bearings (23, 24) positioned in substantially cylindrical first housing (8) and second housing (9) of the casing (2), said bearings (23,24) are positioned between said casing (2) and said shaft (4) and are lubricated by the same liquid treated by the pump.

2. A centrifugal pump as claimed in claim 1, characterised in that the front portion of said first housing (8) is closed by a cover (10), which defines a first chamber (11) hydraulically connected to said plain bearings (3).

3. A centrifugal pump as claimed in claim 2, characterised by having at least a hydraulic connection device (16) between said first chamber (11) and a pump high pressure chamber (20), in order to supply necessary lubricating fluid to said bearing (3).

4. A centrifugal pump as claimed in claim 3, characterised by having a hydraulic connection device (16) between said second chamber (14) and said pump high pressure chamber (20), in order to supply necessary lubricating fluid to said bearing (3).

5. A centrifugal pump as claimed in claim 1, characterised in that said casing (2) has, close to said second housing (9), sealing means (12) associated with said shaft (4), which define at least a second chamber (14) hydraulically connected to said plain bearings.

* * * * *